US012808197B2

(12) United States Patent
Hunckler et al.

(10) Patent No.: US 12,808,197 B2
(45) Date of Patent: Nov. 24, 2026

(54) AWNING DROP SHADE AND ATTACHMENT METHOD

(71) Applicants: Roger Hunckler, Mocksville, NC (US); Clare Hunckler, Mocksville, NC (US)

(72) Inventors: Roger Hunckler, Mocksville, NC (US); Clare Hunckler, Mocksville, NC (US)

( * ) Notice: Subject to any disclaimer, the term of this patent is extended or adjusted under 35 U.S.C. 154(b) by 255 days.

(21) Appl. No.: 17/988,103

(22) Filed: Nov. 16, 2022

(65) Prior Publication Data

US 2024/0159057 A1 May 16, 2024

(51) Int. Cl.
*E04F 10/06* (2006.01)
*E04H 15/08* (2006.01)

(52) U.S. Cl.
CPC ..... *E04F 10/0696* (2013.01); *E04H 15/08* (2013.01)

(58) Field of Classification Search
CPC ... E04F 10/0696; E04F 15/08; E04F 10/0692; E04F 10/0666; E04F 10/06; E04F 10/0681; E04F 15/005
See application file for complete search history.

(56) References Cited

U.S. PATENT DOCUMENTS 2,573,060 A * 10/1951 Rauglas ..... E04H 15/08 135/120.4
2,720,885 A * 10/1955 Legg ..... E04F 10/02 135/120.3
2,967,535 A * 1/1961 Freeman ..... E04H 15/08 135/142
5,246,052 A * 9/1993 Homan ..... E04F 10/0614 160/46
5,303,726 A * 4/1994 Merrill ..... E04H 15/08 403/379.3
6,131,990 A * 10/2000 Crean ..... E04F 10/0614 135/88.11
6,260,909 B1 * 7/2001 Crean ..... E04F 10/0633 135/88.11
10,100,814 B1 * 10/2018 Taylor ..... F03D 9/25
11,220,834 B1 * 1/2022 Corriveau ..... G03B 21/58
2004/0216849 A1 * 11/2004 Goldenberg ..... E06B 9/54 160/23.1
2011/0017413 A1 * 1/2011 Hunckler ..... B60J 11/08 160/370.21

(Continued)

*Primary Examiner* — Daniel P Cahn
*Assistant Examiner* — Matthew R. Shepherd
(74) *Attorney, Agent, or Firm* — Thompson Patent Law Offices PC

(57) ABSTRACT

An awning drop shade that attaches to a motorized retractable awning with a fail-safe removal mechanism that does not interfere with the safe operation of the awning because it automatically removes the drop shade from the awning when the powered awning retracts automatically. A combination of adhesive tapes and magnets is employed to install the shade fabric on the awning. Magnets embedded into the fabric are magnetically attached to corresponding external magnets, which, in turn, are attached to the extended end of the awning with the help of double-sided adhesive tapes. A pair of lanyards tether the installed drop shade to the ground and facilitate its fail-safe removal through magnetic detachment when the awning retracts automatically. Fabric pockets provided on the shading fabric allow insertion of a non-ferrous rod into them to lift the magnet-containing fabric above ground for placement on the extended end of the awning without a ladder.

18 Claims, 7 Drawing Sheets

(56) References Cited

U.S. PATENT DOCUMENTS

| | | | | |
|---|---|---|---|---|
| 2011/0308741 | A1* | 12/2011 | Tessmer | E04F 10/0618 160/54 |
| 2015/0275523 | A1* | 10/2015 | Herrin | E04H 15/58 160/67 |
| 2015/0361717 | A1* | 12/2015 | van 't Zelfde | E06B 9/42 160/327 |
| 2017/0138056 | A1* | 5/2017 | Albertson | E04F 10/0681 |

* cited by examiner

AWNING DROP SHADE AND ATTACHMENT METHOD

TECHNICAL FIELD

This disclosure relates generally to motorized retractable awnings, and more specifically to a drop shade for such awnings that is attachable to the awning from the ground without a ladder and is automatically removed from the awning in the event that the powered awning retracts automatically.

BACKGROUND

The Recreational Vehicle (RV) market has adopted the use of motorized awnings on many product lines, usually in the higher priced RVs and motorhomes. Similarly, motorized awnings are gaining popularity in residential use as well. FIG. 1 is a simplified illustration of an example of a conventional motorized awning 100. The illustration in FIG. 1 shows a fully-extended awning 100 having hardware components 102-105 that deploy the awning fabric (or awning top) 106. For simplicity of illustration, the awning-mounting surface—such as a side of an RV or a wall in a house—and electro-mechanical details of the awning 100 are not shown in FIG. 1. Generally, the awning hardware may include a mounting box 102, a support arm 103, an extending arm 104, and an extended end 105. Although not shown in FIG. 1, a similar support arm and extending arm may be present on the opposite side of the awning as well 100. The awning fabric 106 may cover the top of the awning, providing shade underneath. The length and width dimensions of the awning fabric 106 are indicated by bi-directional arrows 108 and 109, respectively. In the market, there may be many different combinations of lengths and widths (for example, 10 ft×8 ft, 12 ft×8 ft, 13 ft×10 ft, 16 ft×10 ft, and so on) available for the awning top 106. When the awning is fully-deployed, the extended end 105 may maintain the awning top 106 at a pre-determined, fixed height 110 above ground. Typically, such height 110 may be six feet or more depending on the installation.

Many of these motorized awnings are so-called "box awnings" in which the entire awning fabric (such as the fabric 106) and hardware that extends the awning (such as the hardware components 102-105) are contained within a box (such as the box 102) that is mounted on the roof of an RV, on the side of an RV near the roof top, or on the wall of a home. Unlike conventional manually-retractable awnings, the box awnings contain a roller tube (not shown) within the box mounted on the RV or wall in a residential application. A portion of the box extends outward when the awning is deployed.

SUMMARY

This Summary provides a simplified form of concepts that are further described below in the Detailed Description. This Summary is not intended to identify key or essential features and should therefore not be used for determining or limiting the scope of the claimed subject matter.

A powered/motorized awning, such as the awning 100 in FIG. 1, usually deploys higher off the ground than a typical manual awning. This height 110 (FIG. 1), in turn, leaves more area open to sun light and therefore heat, especially when the sun is setting below the level of the extended awning. Therefore, it is desirable to attach an awning drop shade to such powered awnings. An awning drop shade (or, simply, "drop shade") is a shading fabric that is temporarily attached to an awning roller tube or box end-like the extended end 105 in FIG. 1—when the awning is fully extended. The purpose of the awning drop shade is to shade the sun from the area covered underneath the awning, especially when the sun is setting below the height 110 (FIG. 1) of the extended awning. As a result, the drop shade offers not only shading, but also glare reduction and comfort.

Currently, the only way to attach an awning drop shade is by sliding the shade fabric into an existing channel in the roller tube of the awning. However, the earlier-mentioned motorized "box awnings" do not incorporate such a channel into the roller or the box end 105 (FIG. 1) of the automated awning. Because most of these motorized awnings have a wind sensor that will automatically trigger the motor to retract and return the awning to its closed position when needed for safety, the manufacturers of these motorized awnings do not incorporate a way to install a drop shade from the roller tube or box end of the awning. In order to use an awning drop shade with such powered awning systems, the drop shade must have a way to detach itself in the event that the awning would close automatically.

It is therefore desirable to be able to temporarily attach an awning drop shade to a powered awning with a fail-safe removal mechanism that does not interfere with the safe operation of the wind sensor system of the awning. In that regard, it is further desirable that the drop shade be automatically removable from the awning in the event that the powered awning retracts automatically or unexpectedly. Additionally, because of the substantial height of the extended end of a fully-extended motorized awning, it is also desirable to be able to attach the awning drop shade to the extended end from the ground without requiring a ladder so that frequent attachments do not become cumbersome and hazardous.

As a solution, particular embodiments of the present disclosure relate to an awning drop shade for a motorized retractable awning and a method to attach it to the awning. The drop shade as per teachings of the present disclosure is attachable to the awning from the ground without a ladder and is automatically removed from the awning in the event that the powered awning retracts automatically. The shading fabric of the drop shade is temporarily attached to the extended awning's roller tube or box end for use when the awning is extended. A combination of adhesive tapes and magnets is employed to install the shade fabric on the extended end of the awning, while also ensuring easy removal of the shade fabric when needed. Magnets embedded into the fabric are magnetically attached to corresponding external magnets, which, in turn, are attached to the extended end of the awning with the help of double-sided adhesive tapes. A pair of lanyards may tether the installed drop shade to the ground and facilitate its fail-safe removal when the awning retracts automatically. Upon removal, the adhesive tape-connected external magnets may remain on the awning's extended end in a non-interfering manner while allowing the shade fabric to detach itself safely from the awning without loading the awning motor or causing any malfunction during awning's closure. Various fabric pockets provided on the shading fabric allow insertion of a non-ferrous rod into them to conveniently lift the magnet-containing fabric above ground for placement on the extended end of the awning without a ladder. Once the entire length of the shade fabric is installed, the rod is removed.

In one embodiment, the present disclosure is directed to a drop shade assembly for a motorized retractable awning. The assembly comprises: (i) a shade fabric with a plurality of first magnets non-removably placed within the fabric in a spaced-apart manner along the length of a top hem of the fabric; (ii) a plurality of second magnets, wherein each second magnet is paired with a corresponding first magnet and remains magnetically attached thereto when the shade fabric is applied to an extended end of the retractable awning; (iii) a plurality of double-sided adhesive tapes, wherein a first adhesive side of each adhesive tape is to be applied to a corresponding one of the plurality of second magnets and a second adhesive side is to be applied to the extended end of the awning, wherein the top hem of the shade fabric is to be installed on the extended end of the awning through a combination of the following: (a) physical placement of each adhesive tape-bearing second magnet along the length of the extended end of the awning through application of the second adhesive side of a corresponding adhesive tape to the extended end of the awning, and (b) magnetic connection between each pair of first and second magnets; and (iv) a pair of tethers, wherein one end of each tether is attached to a corresponding extreme end of the shade fabric and the other end of each tether is to be secured to the ground after installing the shade fabric on the extended end of the awning. In particular embodiments, each tether may be a lanyard.

In another embodiment, the shade fabric comprises a plurality of fabric pockets, wherein each pocket is integrally formed in the shade fabric at a location of a corresponding one of the plurality of first magnets and over that side of the corresponding first magnet which is to remain unattached to the paired second magnet when the shade fabric is installed on the extended end of the awning, and wherein each pocket provides a downward-facing opening when the shade fabric is installed on the extended end of the awning.

In a further embodiment, the drop shade assembly further comprises a rod to be removably inserted into each pocket-specific downward-facing opening for sequentially lifting and installing a respective portion of the top hem of the shade fabric on the extended end of the awning through placement of the portion-specific, first magnet-attached, adhesive tape-bearing second magnet on the extended end of the awning by affixing respective second adhesive side to the extended end of the awning, thereby facilitating complete installation of the top hem of the shade fabric on the extended end of the awning.

In another embodiment, the present disclosure is directed to a motorized retractable awning system, which comprises: (i) a motorized retractable awning having an extended end; and (ii) a drop shade attached to the extended end of the awning. In the awning system, the drop shade includes: (a) a shade fabric with a plurality of first magnets non-removably placed within the fabric in a spaced-apart manner along the length of a top hem of the fabric, wherein one of the following applies: (I) each first magnet is sewn into the fabric, and (II) each first magnet is welded into the fabric; (b) a plurality of second magnets, wherein each second magnet is paired with a corresponding first magnet and magnetically attached thereto; (c) a plurality of double-sided adhesive tapes, wherein a first adhesive side of each adhesive tape is applied to a corresponding one of the plurality of second magnets and a second adhesive side is applied to the extended end of the awning to thereby install the shade fabric on the extended end of the awning; and (d) a pair of tethers, wherein one end of each tether is attached to a corresponding extreme end of the shade fabric and the other end of each tether is secured to the ground.

In a further embodiment, the present disclosure is directed to a method of installing a drop shade on an extended end of a motorized retractable awning. The method comprises: (i) attaching a first side of each of a plurality of first magnets to a corresponding one of a plurality of second magnets embedded within a shade fabric of the drop shade in a spaced-apart manner along the length of a top hem of the fabric; (ii) applying a first adhesive side of each of a plurality of double-sided adhesive tapes to a second side of a corresponding one of the plurality of first magnets; (iii) further applying a second adhesive side of each adhesive tape to the extended end of the retractable awning, thereby attaching the shade fabric to the extended end of the awning; and (iv) tethering each extreme end of the awning-attached shade fabric to the ground with a pair of substantially inelastic rope-like connectors.

Thus, the magnet-containing and adhesive tape-bearing awning drop shade as per teachings of the present disclosure installs on the extended end of a motorized awning from the ground, without a ladder. The provision of lanyards or other similar tethers at the extreme ends of the drop shade facilitate a fail-safe removal of the drop shade in the event that the awning automatically retracts with the drop shade attached. The drop shade as per teachings of the present disclosure works on powered roller tube or box type awnings that have no factory accommodation for installing a shading fabric.

BRIEF DESCRIPTION OF THE DRAWINGS

A more complete understanding of the present disclosure may be obtained by reference to the following Detailed Description when taken in conjunction with the accompanying Drawings. For ease of discussion, the same reference numbers in different FIGURES indicate similar or identical items.

DETAILED DESCRIPTION

Figure 1:
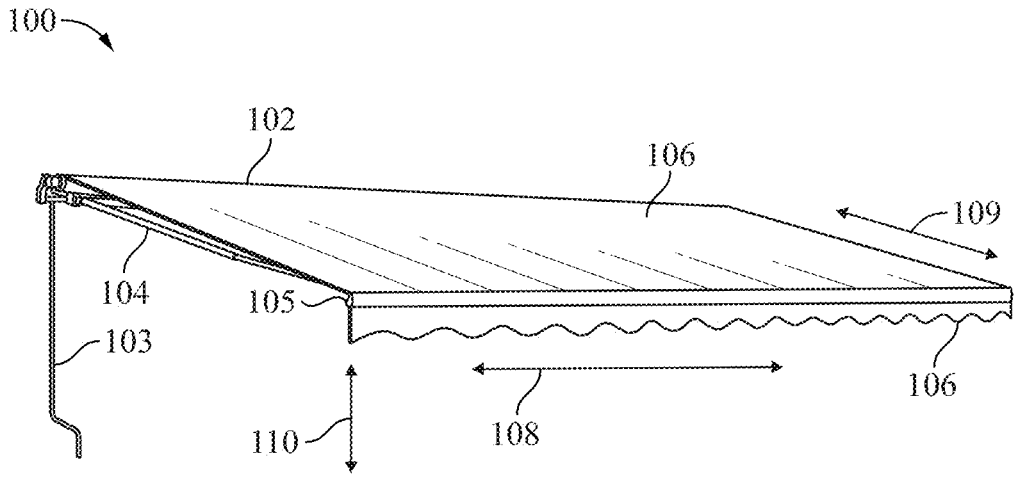
FIG. 1 (Prior Art)
FIG. 1 is a simplified illustration of an example of a conventional motorized awning.

In the following detailed description, numerous specific details are set forth in order to provide a thorough understanding of the disclosure. However, it will be understood by those skilled in the art that the present disclosure may be practiced without these specific details. In other instances, well-known methods, procedures, components and layouts have not been described in detail so as not to obscure the teachings of the present disclosure. Furthermore, this disclosure provides various example implementations or embodiments, as described and as illustrated in the drawings. However, this disclosure is not limited to the implementations described and illustrated herein, but can extend to other implementations, as would be known or as would become known to those skilled in the art.

Reference throughout this specification to "one embodiment," "particular embodiments," "this implementation," "some embodiments," or other terms of similar import, means that a particular feature, structure, or characteristic described in connection with the embodiment is included in at least one embodiment or implementation of the present disclosure. Thus, the appearances of these phrases in various places throughout this specification are not necessarily all referring to the same implementation/embodiment. Furthermore, the particular features, structures, or characteristics may be combined in any suitable manner in one or more embodiments. Also, depending on the context of discussion herein, a singular term may include its plural forms and a plural term may include its singular form. Similarly, a hyphenated term (e.g., "double-sided," "downward-facing", "spaced-apart," etc.) may be occasionally interchangeably used with its non-hyphenated version (e.g., "double sided," "downward facing", "spaced apart," etc.). Such occasional interchangeable uses shall not be considered inconsistent with each other.

The terms "first," "second," etc., as used herein, are used as labels for nouns that they precede, and do not imply any type of ordering (e.g., spatial, temporal, logical, etc.) unless explicitly defined as such. Furthermore, items or features appearing in different FIGURES may be identified using the same reference numeral for ease of discussion. However, such identification does not imply that the commonly-referenced items/features are identical across all embodiments.

It is noted that various FIGURES shown and discussed herein are for illustrative purpose only, and are not drawn to scale. Furthermore, although box type powered awning is illustrated throughout, the drop shade as per teachings of the present disclosure may be applied to any motorized awning regardless of the awning construction or type.

Figure 2:
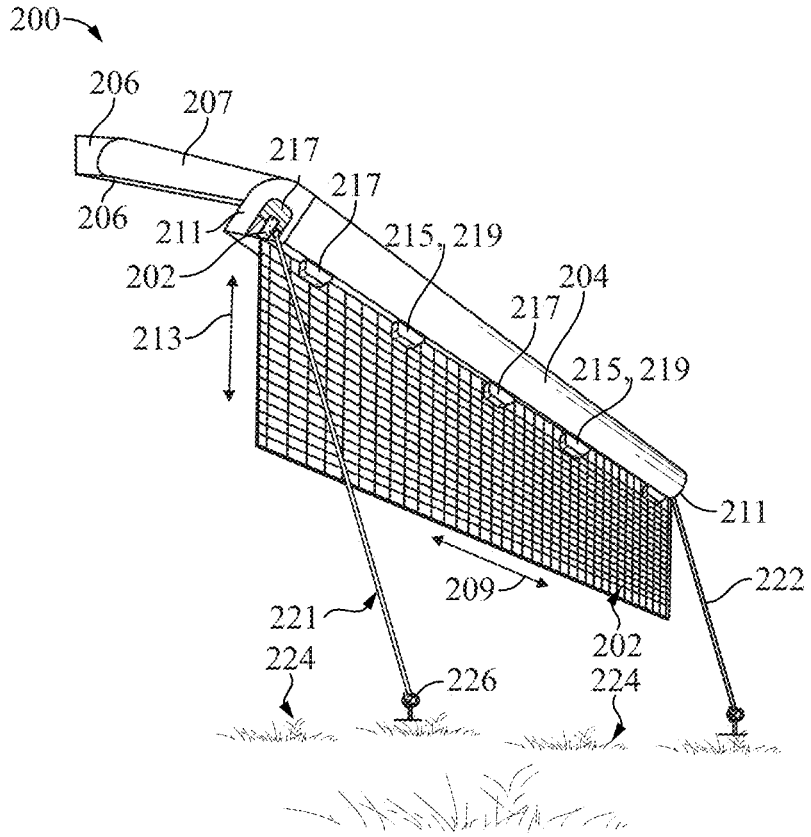
FIG. 2 is an exemplary partial isometric view of a drop shade having a shading fabric attached to an extended end of a motorized retractable awning as per particular embodiments of the present disclosure.

FIG. 2 is an exemplary partial isometric view of a drop shade 200 having a shading fabric 202 attached to an extended end 204 of a motorized retractable awning 206 as per particular embodiments of the present disclosure. The portion identified by the reference numeral "204" also may be considered the facia of the extended end in some embodiments, as discussed later with reference to FIG. 7. For simplicity of the drawing and because of lack of relevance to the present disclosure, various hardware and structural details of the awning are not shown in FIG. 2. Hence, the reference numeral "206" is used to identify the entire motorized awning even though only a small hardware portion of the awning is shown in FIG. 2. A comparison with FIG. 1 shows that the portion associated with the reference numeral "206" may relate to the mounting box and the left extending arm of the awning. The reference numeral "207" identifies the left-hand edge of the awning top (not fully shown in FIG. 2), which may be similar to the top 106 in FIG. 1. In the embodiment of FIG. 2, the awning 206 is the earlier-mentioned "box awning." Hence, the extended end 204 of the awning 206 may be an awning roller tube or box end, as also mentioned before with reference to discussion of FIG. 1.

It is noted here that although a drop shade is essentially a shading fabric, for ease of discussion, the terms "drop shade" and "shade fabric" (or "shading fabric" or "fabric") may be used separately and interchangeably herein. Furthermore, as discussed later, although the shade fabric 202 in FIG. 2 is installed on the extended end 204 using various attachment components such as, for example, magnets and adhesive tapes, the term "drop shade" is used herein as an all encompassing term to include such attachment components as well. Thus, although the term "drop shade assembly" occasionally may be used to refer to a kit or collection of the constituent components of the drop shade 200—such as, for example, the shade fabric 202 and its attachment components, the terms "drop shade" and "drop shade assembly" remain synonymous and interchangeable for ease of discussion, as may be evident from the context. Finally, the terms "extended end" and "awning end" may be used interchangeably as well.

Referring again to FIG. 2, it is observed that the drop shade 200 may be manufactured from the shading fabric 202 that may have an "open value" of varying degree or no open value. A fabric may be considered to have an "open value" when it allows an individual to see outside through the fabric, but also retains privacy from others trying to look into the fabric from outside. In particular embodiments, the fabric 202 may be cut to the total length of the awning roller tube or box end 204 or may be made at a lesser length depending on the individual preference. In the embodiment of FIG. 2, the length 209 of the shade fabric 202 is slightly more than that of the extended end 204 because of provision of additional fabric for mounting on the sides 211 of the extended end 204. In FIG. 2, the left-hand side 211 of the end 204 is shown with attached fabric 202. Similar arrangement (not shown) may be present on the right-hand side of the extended end 204. The height 213 or vertical drop of the shade fabric 202 also may vary depending on the desired installation preference. For example, the height 213 may be 3 ft, 4 ft, 5 ft, or any other commercially-suitable dimension. In any event, the height 213 of the fabric 202 may be cut to the expected finished length of the awning drop shade plus an additional length added anywhere from 1 inch or more on the top to create a horizontal hem on the top. The hem is not visible in FIG. 2, but is shown and identified by reference numeral "302" in FIG. 3. In one embodiment, the hem may accommodate a first set of rare earth magnets 215, which may be non-removably placed or embedded within the fabric 202 in a spaced-apart manner along the length 209 of the fabric. For example, each magnet 215 may be sewn or cloth-welded into the fabric with an open pocket 217 over it. Each pocket 217 may provide a downward-facing opening when the shade fabric 202 is to be installed on the extended end 204. Thus, as discussed later with reference to FIG. 5, each such pocket 217 may be used to accommodate the tip of a non-ferrous rod, which may be used to raise/lift the awning drop shade fabric 202 for installation on the extended end 204 without a ladder. In one embodiment, the magnets 215 may be equally spaced along the length 209 of the fabric 202 and also manufactured with the open pocket design at each magnet location. For example, such equal spacing may be six inches, eight inches, or any other suitable distance. In other embodiments, the magnets 215 may not be so equally-spaced.

The illustration in FIG. 2 depicts the complete drop shade assembly in an installed form. Hence, two attachment components of this assembly are not visible in FIG. 2. These components include a second set of rare earth magnets 219 (visible in FIGS. 3-5) and a corresponding set of double-sided adhesive tapes (not individually shown in any figure). In one embodiment, the second set of rare earth magnets 219 are provided in a loose form and may be of similar shape and size to that of the first set of magnets 215. The number of loose magnets 219 may be at least equal to or slightly more than the number of fixed magnets 215 to account for any loss or misplacement. During installation of the drop shade, each loose magnet 219 is paired with a corresponding fabric-embedded magnet 215 and remains magnetically attached to the fabric magnet 215 when the fabric is applied to the extended end 204. More specifically, first the loose rare earth magnets 219 may be magnetically attached to the corresponding magnets 215 under the pockets 217 of the horizontal hem section 302 (FIG. 3) of the drop shade fabric 202, whereby each loose magnet 219 will attract to the corresponding fixed magnet 215 contained within the hem 302 at the location of the respective pocket 217, thus aligning to the contained rare earth magnet with proper polarity. Once the loose magnets 219 from the second set are placed on each awning-facing side of the pocket 217, one side of each double-sided adhesive tape is applied to the exposed (or awning-facing) portion of each corresponding loose magnet 219 that will face the bottom, side, or end of the extended end 204. For secure and long-term placement of the magnets 219 on the extended end 204 (as discussed below), each double-sided adhesive tape may be a high-temperature adhesive tape.

Beginning with the furthest end pocket 217 associated with the side 211 of the extended end 204, the completed drop shade 200 may be aligned to the extended end 204 one magnet pair (of magnets 215 and 219) at a time. More specifically, once centered and aligned at either side 211 of the extended end 204, the adhesive tape-bearing rare earth magnet 219 (which is also magnetically-attached to the corresponding paired magnet 215) at the end of the fabric 202 is attached to the respective side 211 by peeling the protective film from the double-sided adhesive tape and anchoring the tape-bearing magnet 219 to the extended end 204 by affixing the exposed, awning-facing side of the adhesive tape to the side 211 of the awning end 204. From this point, this installation process may be repeated along the length of the extended end 204—one magnet pair at a time—until all of the exposed or loose magnets 219 are now permanently attached to the extended end 204, thereby holding the shade fabric 202 in position as it hangs from the length of the end 204 of the awning 206. As mentioned earlier and discussed in more detail later with reference to FIG. 5, a non-ferrous rod may be optionally provided as part of the drop shade assembly to lift or raise a portion of the fabric 202 above ground through a corresponding pocket 217 and place the portion-specific, adhesive-tape bearing loose magnet 219 (which is already attached to a corresponding fixed magnet 215) on the extended end 204 by affixing the exposed adhesive side of the respective adhesive tape on the extended end 204. After attaching the relevant portion to the extended end 204, the rod may be removed from the corresponding pocket 217 and re-inserted into an adjacent pocket 217, and the process may be repeated sequentially till all the magnet pairs (of magnets 215 and 219) are securely placed on the extended end 204 and the shade fabric 202 freely and securely hangs from the awning end 204. The rod then may be completely removed from the attached drop shade.

In one embodiment, to facilitate fail-safe removal of the drop shade 200, the drop shade assembly or kit may include a pair of tethers 221-222. One end of each tether 221, 222 may be attached to a corresponding extreme end of the shade fabric 202, and the other end may be appropriately secured to the ground 224, for example, via a peg 226 or other supporting mechanism inserted into the ground 224, as illustrated in FIG. 2 (with reference to the tether 221). In particular embodiments, each tether may be a substantially inelastic tether such as, for example, a lanyard that provides resistance necessary to effectuate detachment of magnetically-attached pairs of magnets 215, 219 in the event of automatic retraction of the awning 206. On the other hand, in some embodiments, each tether may be an elastic cord with proper elasticity to prevent removal of the installed magnets 215 (and, hence, the installed shade fabric 202) while the extended end 204 is stationary and with sufficient resistance to allow safe and quick detachment of the magnets 215 from the paired magnets 219 when the extended end 204 automatically retracts. The adhesive-applied loose magnets 219 may remain affixed to the extended end 204 in a non-obstructing manner, thereby allowing safe and secure closure of the awning 206. In some embodiments, the elastic material may be a bungee cord type material.

It is observed here that each tether-bearing extreme end of the shade fabric 202 may be within the top hem 302 of the fabric 202 as, for example, in the embodiment of FIG. 2. However, in some embodiments, each tether-bearing extreme end of the shade fabric may be below the top hem of the fabric. The lanyards 221-222 may be of varying length depending on the installed configuration of the drop shade and, as noted above, may be anchored to the ground 224 when the completed awning drop shade 200 is installed on the extended end 204. Thus, the lanyards 221-222 provide the failsafe system portion of the drop shade assembly. As shown in FIGS. 2-5, in some embodiments, the lanyards 221-222 may be permanently attached to the magnet fabric pockets 217*a* at each end of the finished drop shade fabric 202 so as to facilitate quick, safe, and automatic removal of the drop shade 200 in the event that the powered awning 206 would close in high wind or by user error. The installation of the drop shade 200 in the manner discussed above allows the drop shade fabric 202 to swing freely in the breeze, but if the powered awning 206 retracts automatically, the lanyards 221-222 will stay in a fixed position anchored to the ground as the awning end 204 retracts. As a result of the pull exerted through the fixed lanyards 221-222, the attached drop shade 200 (more specifically, the fixed magnet-containing shading fabric 202) will then remove itself from the retracting awning end 204 as the awning 206 retracts to the fully-stored position and will then fall harmlessly to the ground.

As mentioned before, in some embodiments, the drop shade assembly may be marketed as a kit of separate components to be assembled by the customer to magnetically attach the shade fabric 202 on the awning end 204 in the manner discussed earlier. The kit may contain: the shade fabric 202 having a pre-defined dimension and with magnets 215 embedded along the length of its top hem 302; a set of loose magnets 219 for magnetic attachment to corresponding fixed magnets 215 in the shade fabric 202; a set of double-sided adhesive tapes for affixing the loose magnets 219 (which will be magnetically attached to the fixed magnets 215 during installation) on the awning edge 204; and a pair of tethers 221-222 for automatic and fail-safe removal of the drop shade 200. The tethers 221-222 may be permanently attached to the drop shade fabric 202, or may be removably attachable to the shade fabric 202 by the customer. Upon assembly of these components, the top hem 302 of the shade fabric 202 is installed on the extended end 204 of the awning 206 through a combination of: (i) physical placement of loose magnets 219 on the extended end 204 with the help of adhesive tapes, and (ii) magnetic connection between each loose magnet 219 and its corresponding fixed magnet 215. As noted before, a non-ferrous rod (shown in FIG. 5) also may be provided as part of the drop shade kit to facilitate safe and easy installation of the shade fabric 202 from the ground without a ladder. In certain embodiments, a pair of pegs 226—one peg for each tether 221, 222—also may be included as part of the drop shade kit. The pegs 226 may be wooden pegs or something similar.

Figure 3:
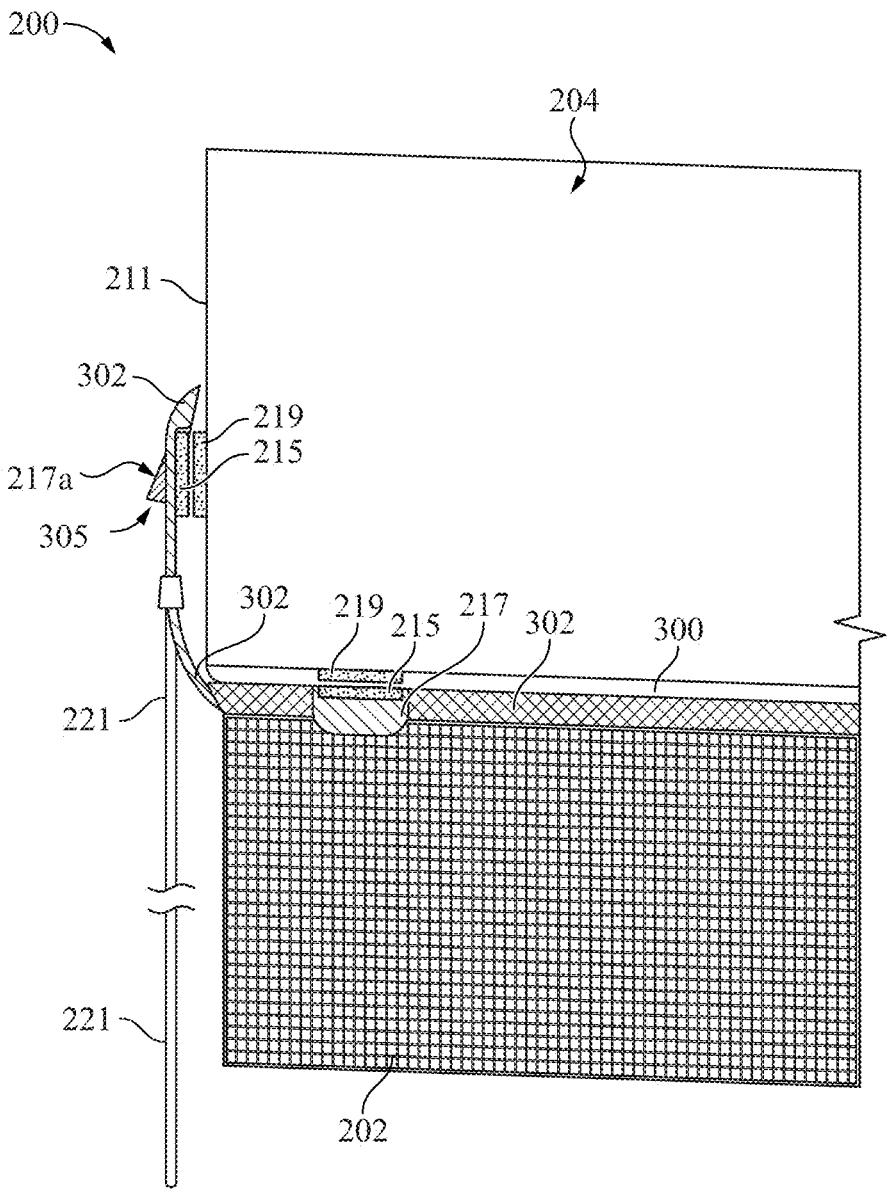
FIG. 3 shows the front view of a portion of the drop shade attachment configuration illustrated in FIG. 2.

FIG. 3 shows the front view of a portion of the drop shade attachment configuration illustrated in FIG. 2. For clarity, only a partial layout of the shade fabric 202 and associated magnets 215, 219 is shown along with a portion of the awning end 204 in FIG. 3. Various components common between FIGS. 2 and 3 are identified using the same reference numerals for ease of reference, but their earlier discussion is not repeated here for the sake of brevity. It is seen from FIG. 3 that a border or peripheral edge 300 of the extended end 204 closest to the ground may be selected to affix various loose magnets 219 thereon with adhesive tapes. Hence, in the event the awning retracts and the shade fabric 202 is removed as discussed before, the magnets 219 stuck to the surface 300 will not impede the safe closure of the powered awning. The top hem 302 of the shade fabric 202 is also clearly identified in FIG. 3 along with the magnets 215 inserted therein throughout its length, as discussed before. As shown in FIGS. 2-3, the top hem 302 of the shade fabric 202 extends to the side 211 of the awning end 204 for additional mounting support. The lanyard or a similar tether 221 may be attached—permanently or removably—to the extreme end of the top hem 302 and close to the pocket 217 to be mounted on the side 211 of the extended end 204 as shown, for example, in the embodiments of FIGS. 2-5. It is noted here that although the magnets 215, 219 in FIGS. 2-5 are shown as having a rectangular shape, in certain embodiments, these magnets may be circular, oblong, square, oval, or in any other suitable shape that allows retention of the shade fabric 202 on the awning edge 204 with adhesive-based affixation in the manner discussed herein.

As mentioned earlier, the magnets 215 may be sewn or welded into the fabric of the shade fabric 202. In one embodiment, the magnets 215 may be part of the fabric pockets 217*a* in the sense that they may placed within the fabric pockets 217*a*, which are then sewn or welded to make the magnets 215 non-removable or fixed. Alternatively, the fixed magnet-containing locations of the shade fabric 202 may be considered "separate" from the pockets 217 and the pockets 217 may be considered to be integrally formed in the shade fabric 202 at such locations of the corresponding fixed magnets 215 and over that side of each fixed magnet 215 which is to remain unattached to the paired (loose) magnet 219 when the shade fabric 202 is installed on the extended edge 204. Regardless of whether the pocket 217 is treated as a magnet-containing entity or not, in particular embodiments, each fabric pocket 217*a* may provide a downward-facing opening 305 to receive the non-ferrous rod (FIG. 5) to facilitate installation of the shade fabric 202 on the extended edge 204 from the ground without a ladder. As noted before and as shown in FIG. 3, in certain embodiments, the shade fabric 202 may include a fabric pocket on each end of the top hem 302 for placement over a corresponding side corner 211 of the extended end 204.

Figure 4:
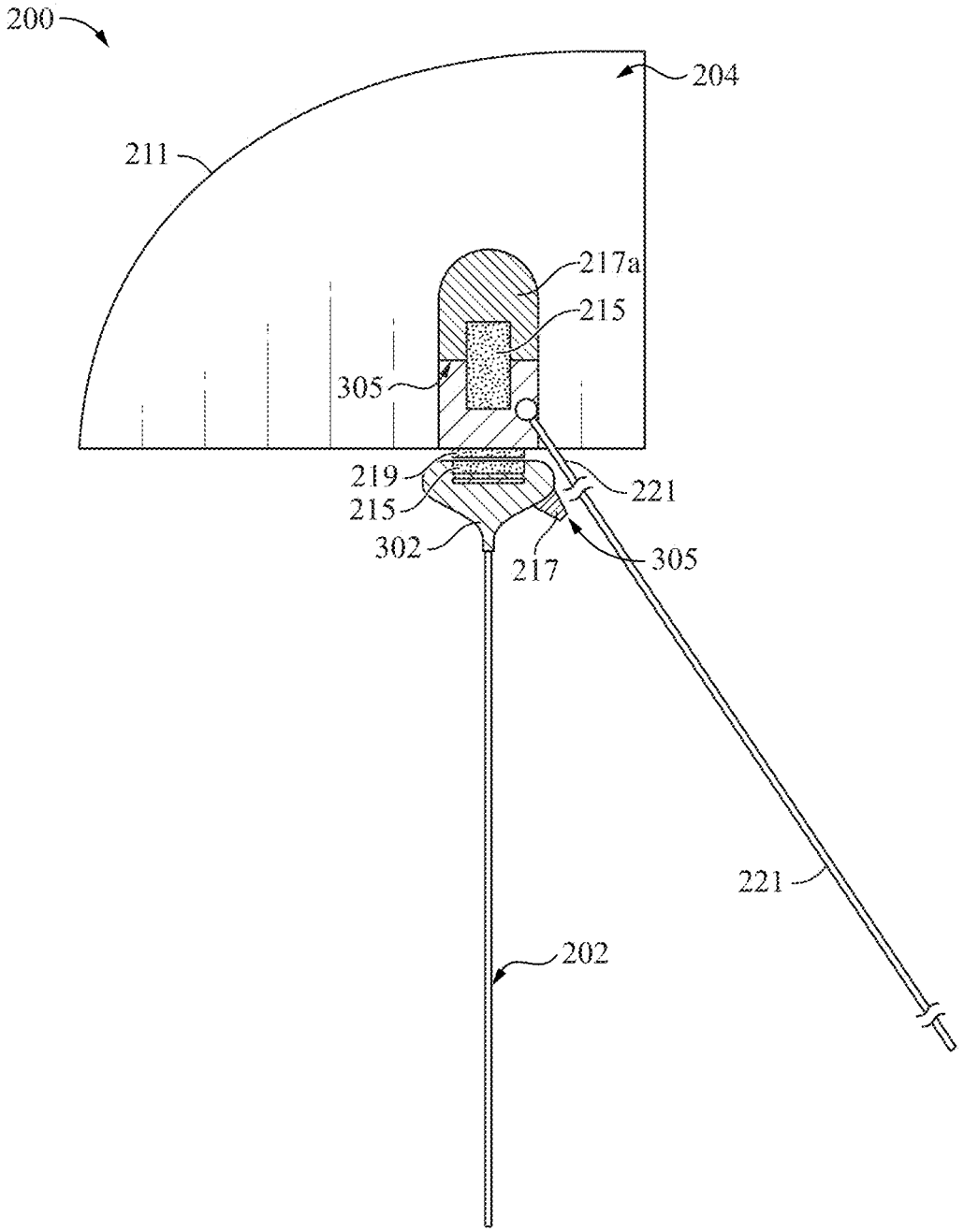
FIG. 4 is the left-side end view of a portion of the drop shade attachment configuration shown in FIG. 2.

FIG. 4 is the left-side end view of a portion of the drop shade attachment configuration shown in FIG. 2. Various components common between FIGS. 2-4 are identified using the same reference numerals for ease of reference, but their earlier discussion is not repeated here for the sake of brevity. The illustration in FIG. 4 is self-explanatory in view of discussion of FIGS. 2-3.

Figure 5:
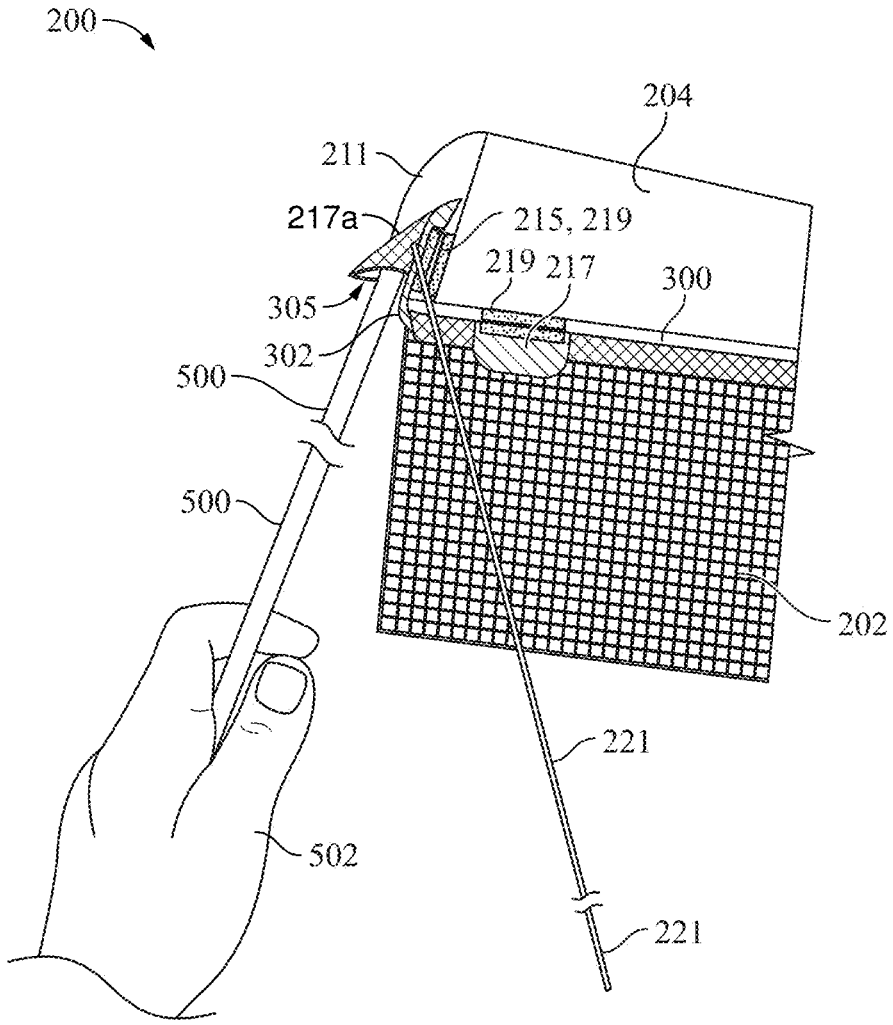
FIG. 5 illustrates an exemplary partial isometric view of how a rod may be used to install the drop shade of FIG. 2 without a ladder as per teachings of the present disclosure.

FIG. 5 illustrates an exemplary partial isometric view of how a rod 500 may be used to install the drop shade 200 of FIG. 2 without a ladder as per teachings of the present disclosure. For clarity, only a partial layout of the shade fabric 202, associated magnets 215, 219, and pockets 217 is shown along with a portion of the awning end 204 in FIG. 5. Various components common between FIGS. 2-5 are identified using the same reference numerals for ease of reference, but their earlier discussion is not repeated here for the sake of brevity. As noted before, in some embodiments, the rod 500 may be a non-ferrous rod like a tilt wand sold with window blinds. The non-ferrous rod may be provided in various dimensions such as, for example, ¾ inch to 1 inch in diameter and 2.5 to 3 feet in length. A human hand 502 is shown in FIG. 5 holding the rod 500, the tip of which is inserted into the downward-facing opening 305 of the corner pocket 217 to raise the corresponding portion of the shade fabric 202 off the ground to attach the end of its top hem 302 on the side 211 of the extended end 204. After installing the magnet pair 215, 219 with the help of the adhesive tape (as discussed before) on the side 211, the rod 500 may be removed from the respective fabric pocket 217*a* and re-inserted into the next pocket 217 on the right. The rod insertion, fabric lifting, magnet attachment, and rod removal process may be repeated from one side of the extended end 204 to the other side till all the magnets 215 contained within the pockets of the awning drop shade attach themselves to the edge 300 of the extended end 204 through the respective, adhesive-bearing magnets 219. After the shade fabric 202 is completely installed on the extended end 204, the rod 500 may be removed and stored for future use. The rod thus facilitates lifting of the magnet-bearing shade fabric so that the drop shade can be installed from the ground without a ladder.

Figure 6:
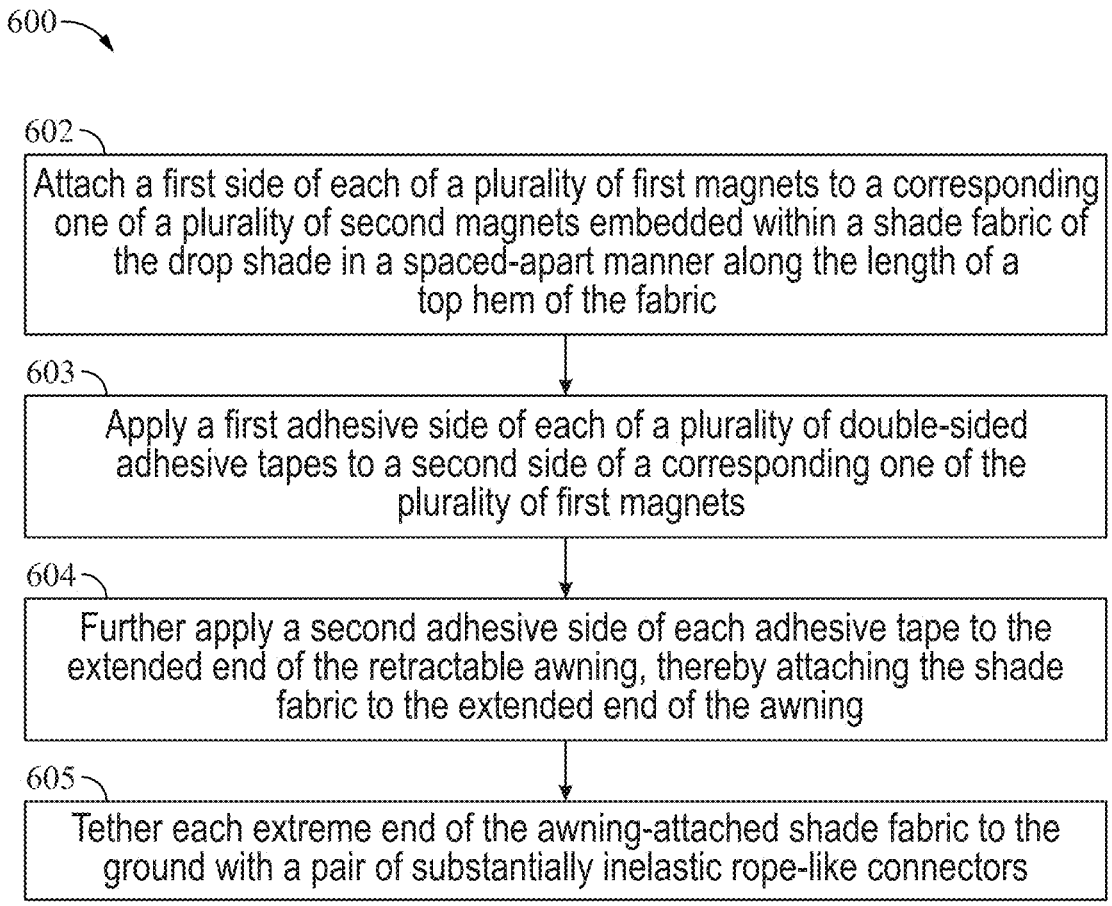
FIG. 6 depicts an exemplary flowchart of a method of installing the drop shade of FIG. 2 as per certain embodiments of the present disclosure.

FIG. 6 depicts an exemplary flowchart 600 of a method of installing the drop shade 200 of FIG. 2 as per certain embodiments of the present disclosure. In the flowchart 600 each block represents one or more tasks that may be performed by a human to install the drop shade 200 as per teachings of the present disclosure. The order in which the blocks are described is not intended to be construed as a limitation, and some of the described tasks can be combined in any order and/or in parallel to implement the process shown in the flowchart 600. For discussion purpose, the process in the flowchart 600 is described with reference to various components illustrated in FIGS. 2-5.

Referring now to FIG. 6, initially, as noted at block 602, the person installing the drop shade 200 may attach a first side of each of a plurality of first magnets (such as the loose magnets 219) to a corresponding one of a plurality of second magnets (such as the fixed magnets 215) embedded within a shade fabric (such as the shade fabric 202) of the drop shade in a spaced-apart manner along the length of a top hem of the fabric (such as the top hem 302). The person may then apply a first adhesive side of each of a plurality of double-sided adhesive tapes (not shown) to a second side of a corresponding one of the plurality of first magnets 219, as noted at block 603. The person may further apply a second adhesive side of each adhesive tape to the extended end 204 of the retractable awning 206, thereby attaching the shade fabric 202 to the extended end of the awning, as noted at block 604. Once the shade fabric 202 is completely installed on the awning end 204, the person may tether each extreme end of the awning-attached shade fabric 202 to the ground 224 with a pair of substantially inelastic rope-like connectors (such as the tethers 221-222), as noted at block 605. In one embodiment, the pair of tasks at blocks 603, 604 may be performed sequentially using one double-sided adhesive tape at a time. In certain embodiments, the installation method also may include the person removably inserting a non-ferrous rod into each pocket of the shade fabric to lift the shade fabric to apply the second adhesive side of each corresponding adhesive tape to the extended end of the awning.

More specifically, the installation method allows for temporary (removable) attachment of the shade fabric 202 to the extended end 204. As discussed before, the attachment method is by way of a magnetic system (of magnet pairs 215, 219) that also incorporates a closure fail-safe as well as a method to install the drop shade 200 from the ground regardless of the extended height of the awning 206 above the ground surface. The discussion here relates to re-attachment of the shade fabric 202 that was previously attached to the extended end 204 and subsequently removed (manually or automatically). Initially, an individual may deploy his or her motorized awning to cover their patio area or other area (such as the ground in the vicinity of an RV on which the awning is mounted). Once the awning is fully deployed/extended, the individual may unroll the drop shade 200 (more specifically, the shading fabric 202) and then insert the tip of the non-ferrous rod 500 into one of the fixed magnetic-bearing fabric pockets 217*a* at either end of the shade fabric 202 and raise that end of the shade fabric 202 to connect to the corresponding rare earth magnet 219 that was previously attached to the awning end 204 (more specifically, on the surface 300 of the awning end 204) and remained there even though the shade fabric 202 was removed then after use or otherwise. The user may then raise and similarly attach the other end of the shade fabric 202 or continue from the first-attached end-one pocket-specific magnet pair (of magnets 215, 219) at a time-until all of the magnetic bearing fabric pockets 217*a* are again fully attached to the surface 300 of the awning end 204. Next, the user may attach the ends of the lanyards 221-222 to the ground 224 by various means, but secure enough so as not to move the lanyards 221-222 with the awning 206 in the event that the awning 206 retracts automatically. The installed drop shade 200 now gives additional shade to the patio area or other area in the vicinity of the RV or motorhome when the sun is setting below the horizontal level of the extended end 204. The drop shade fabric 202 also can swing freely in the breeze causing no effect on the main awning 206.

As mentioned before, in the event that the wind sensor of the awning 206 signals the awning 206 to retract automatically on its own (or even if the automatic retraction is due to a human error), the lanyards 221-222 that are attached close to the fabric pockets 217 mounted on the sides 211 of the awning end 204 will remain fixed to the ground. As the awning 206 retracts to its stored position, the lanyards 221-222—being fixed to a point on the ground—would allow the awning to retract normally. However, the drop shade 200 (through its shade fabric 202) is held by the lanyards 221-222. Hence, because of the retracting awning 206, the pull exerted by the fixed lanyards 221-222 would force the magnet pairs 215, 219 to disengage. As a result, the shade fabric 202 (containing the fixed magnets 215) would fall harmlessly to the ground as the awning 206 moves to its stored position on the RV, motorhome, or residence.

Figure 7:
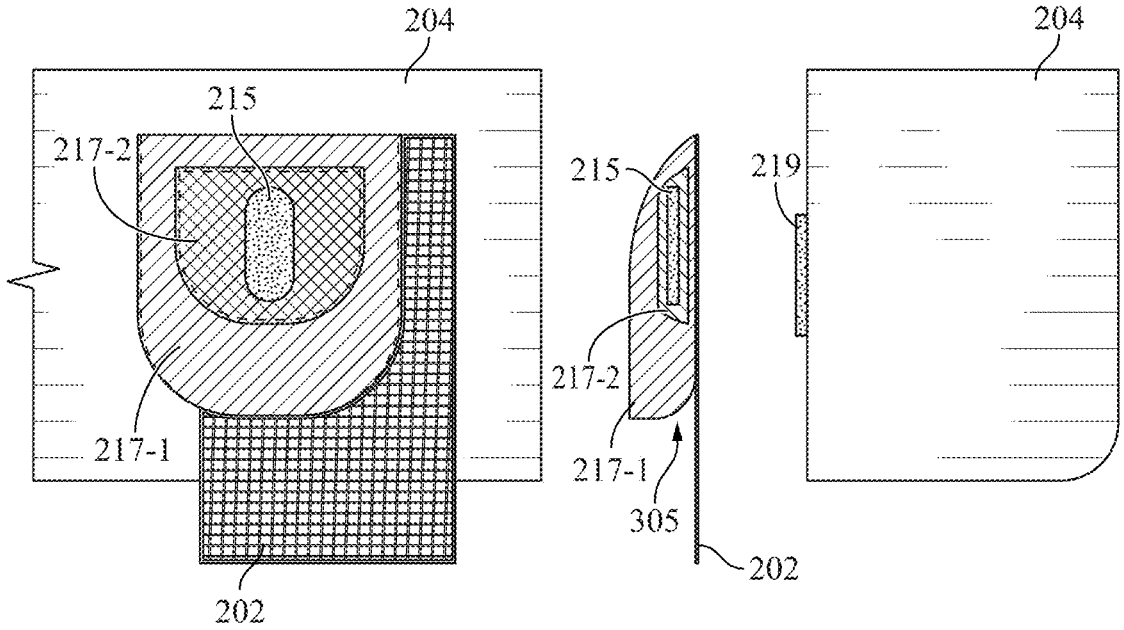
FIG. 7 shows an optional configuration depicting partial front and side views of how the drop shade as per teachings of the present disclosure may be mounted on the facia of the awning box (or roller tube).

FIG. 7 shows an optional configuration depicting partial front and side views of how the drop shade 202 as per teachings of the present disclosure may be mounted on the facia 204 of the awning box (or roller tube). Various components common between FIGS. 2-5 and 7 are identified using the same reference numerals for ease of reference, but their earlier discussion is not repeated here for the sake of brevity. The embodiment in FIG. 7 relates to those awning boxes (or roller tubes) that do not have clearance-such as the surface 300 shown in FIGS. 3 and 5—to accommodate mounting of the magnets 215, 219 on the bottom of the awning box. In case of such awnings, the magnet-bearing shading fabric 202 may be attached directly on the facia 204 of the extended end as illustrated in FIG. 7. It is observed here that FIG. 7 also depicts additional details of the pockets 217 in which each of the pockets 217 may be considered to be composed of two parts—an outer portion 217-1 providing the downward-facing opening 305, and the magnet-bearing inner portion 217-2 sewn/welded into the shading fabric 202. Additionally, in the embodiment of FIG. 7, the fixed magnets 215 are shown as having an oblong shape. The loose magnets 219 also may be of the oblong shape for ease of attachment.

Figure 8A:
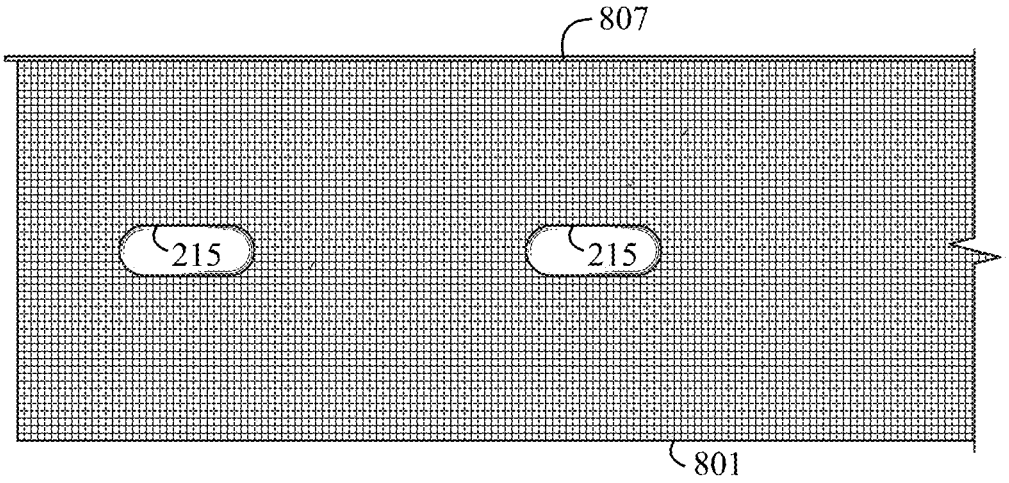
FIG. 8A illustrates a front elevation view of the first panel including a fabric having a plurality of magnets, according to some embodiments.
Figure 8B:
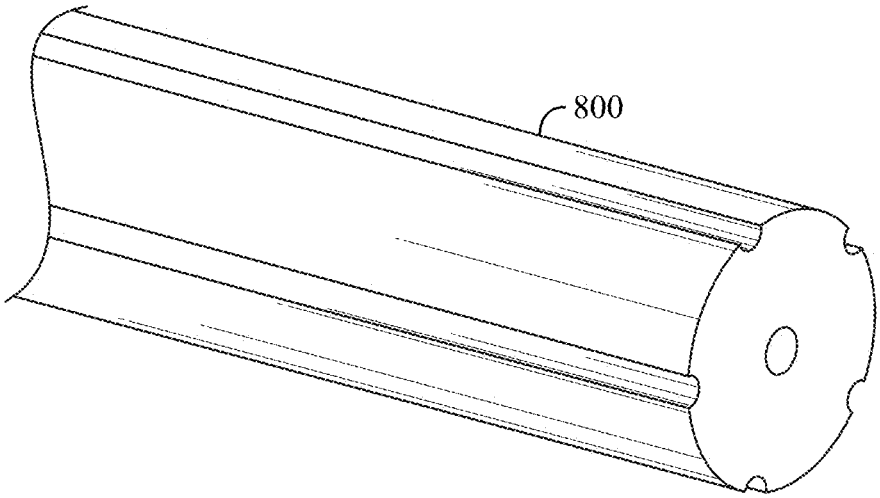
FIG. 8B illustrates a perspective view of the roller tube, according to some embodiments.
Figure 8C:
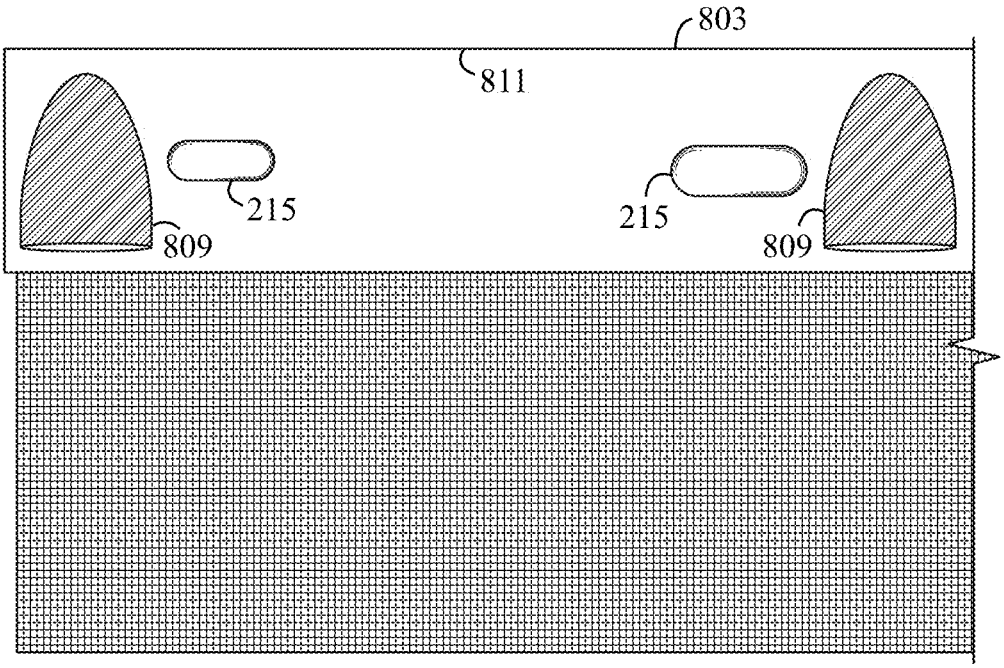
FIG. 8C illustrates a front elevation view of the second panel, according to some embodiments.

FIG. 8A-8C illustrate an alternative embodiment wherein the awning 206 is attached magnetically using a roller tube 800 using fixed magnets 215 positioned on a first panel 801. The attachment method allows for the awning drop shade to be magnetically attached to the awning 206 using a roller tube 800 which consists of the first panel 801 and second panel 803. The first panel 801 includes a fabric 805 that contains a plurality of fixed magnets 215 which may be made of rare earth magnets along a length of the first panel 801. The fixed magnets 215 are attached via sewing or welding into a pocket of the same or similar fabric as the first panel 801. A top hem 805 of the first panel 801 includes a plastic cord sized to be able to slide into a channel of the roller tube 800. The first panel 801 is shorter vertically than the second panel 803 to retain it on the roller tube 800 while hanging vertically at various lengths (about 12-inches thereabout).

The second panel 803 is a shading fabric which is longer vertically than the first panel 801 and includes a plurality of fixed magnets 215 which are sewn or welded into the top hem 805 of the fabric of the second panel 803. The fixed magnets 215 of the second panel 803 are spaced to correspond to the location of the fixed magnets 215 of the first panel 801. The second panel 803 includes a plurality of pockets 807 along the length of the top hem 805 to accept the tip of a rod (e.g., a non-ferrous rod) used to raise the second panel 803 upwards to the first panel 801 whereby the attraction of the fixed magnets 215 in the first panel 801 and second panel 803 attach each panel together magnetically. Removal of the second panel 803 from the first panel 801 is accomplished by pulling down on the second panel 803. If the particular roller awning is of a powered type with a wind sensor, the second panel 803 can detach itself by way of a tether as in previous example described hereinabove. As the awning moves in the tether which is attached to the ground creates tension on the cord as the awning moves in thereby separating the magnetically attached panels.

In the preceding description, for purposes of explanation and not limitation, specific details are set forth (such as particular structures, components, techniques, etc.) in order to provide a thorough understanding of the disclosed awning drop shade and its attachment method. However, it will be apparent to those skilled in the art that the disclosed system may be constructed in other embodiments that depart from these specific details. That is, those skilled in the art will be able to devise various arrangements which, although not explicitly described or shown herein, embody the principles of the disclosed system. In some instances, detailed descriptions of well-known components and construction methods are omitted so as not to obscure the description of the disclosed system with unnecessary detail. All statements herein reciting principles, aspects, and embodiments of the disclosed system, as well as specific examples thereof, are intended to encompass both structural and functional equivalents thereof. Additionally, it is intended that such equivalents include both currently known equivalents as well as equivalents developed in the future, such as, for example, any elements developed that perform the same function, regardless of structure.

Alternative embodiments of the drop shade system for motorized awnings according to inventive aspects of the present disclosure may include additional components responsible for providing additional functionality, including any of the functionality identified above and/or any functionality necessary to support the solution as per the teachings of the present disclosure. Although features and elements are described above in particular combinations, each feature or element can be used alone without the other features and elements or in various combinations with or without other features.

The foregoing describes an awning drop shade that attaches to a motorized retractable awning with a fail-safe removal mechanism that does not interfere with the safe operation of the awning because it automatically removes the drop shade from the awning when the powered awning retracts automatically. A combination of adhesive tapes and magnets is employed to install the shade fabric on the awning. Magnets embedded into the fabric are magnetically attached to corresponding external magnets, which, in turn, are attached to the extended end of the awning with the help of double-sided adhesive tapes. A pair of lanyards tether the installed drop shade to the ground and facilitate its fail-safe removal through magnetic detachment when the awning retracts automatically. Fabric pockets provided on the shading fabric allow insertion of a non-ferrous rod into them to lift the magnet-containing fabric above ground for placement on the extended end of the awning without a ladder.

Although the present disclosure has been described in connection with several embodiments, the disclosure is not intended to be limited to the specific forms set forth herein. On the contrary, it is intended to cover such alternatives, modifications, and equivalents as can be reasonably included within the scope of the disclosure as defined by the appended claims.

What is claimed is:

1. A drop shade assembly comprising:

a shade fabric with a plurality of first magnets affixed within the shade fabric in a spaced-apart manner along a length of a top hem of the fabric;

a plurality of second magnets, wherein each second magnet is paired with a corresponding first magnet and remains magnetically attached thereto when the shade fabric is releasably coupled to an extended end of a retractable motorized awning;

a pair of rope-like tethers, wherein one end of each tether is directly attached to a corresponding extreme end of the shade fabric, and an opposing end of each tether is configured to be secured to the ground;

a plurality of double-sided adhesive tapes, wherein a first adhesive side of each adhesive tape is configured to couple to a corresponding one of the plurality of second magnets and a second adhesive side is configured to couple to an extended end of the awning, wherein the top hem of the shade fabric is configured to couple to the extended end of the awning through an installation process comprising:

placing each second magnet along a length of the extended end of the awning through application of the second adhesive side of a corresponding adhesive tape to the extended end of the awning, wherein the placing creates a magnetic connection between each pair of first and second magnets; and, wherein a magnetic attachment between the shade fabric and the extended end of the awning is configured to automatically disengage such that the shade fabric decouples when the motorized retractable awning retracts to a stored position;

wherein the shade fabric comprises:

a plurality of fabric pockets, wherein each pocket is integrally formed in the shade fabric at a location of a corresponding one of the plurality of first magnets over a side of a first magnet of the plurality of first magnets that is unattached to a paired second magnet of the plurality of second magnets when the shade fabric is installed on the extended end of the awning, and wherein each pocket provides a downward-facing opening when the shade fabric is installed on the extended end of the awning.

2. The assembly of claim 1, wherein each extreme end of the shade fabric is within the top hem of the fabric.

3. The assembly of claim 1, wherein each extreme end of the shade fabric is below the top hem of the fabric.

4. The assembly of claim 1, wherein the length of the top hem of the fabric is longer than the length of the extended end of the awning.

5. The assembly of claim 1, wherein the length of the top hem of the fabric is shorter than the length of the extended end of the awning.

6. The assembly of claim 1, wherein each tether is a lanyard.

7. The assembly of claim 1, wherein each tether is an elastic cord.

8. The assembly of claim 1, wherein each first magnet is sewn into the fabric.

9. The assembly of claim 1, further comprising:

a rod configured to be removably inserted into each downward-facing opening for sequentially lifting and installing a respective portion of the top hem of the shade fabric on the extended end of the awning through placement of a second magnet of the plurality of second magnets on the extended end of the awning by affixing a respective second adhesive side of a respective adhesive tape of the plurality of double-sided adhesive tapes to the extended end of the awning, thereby facilitating complete installation of the top hem of the shade fabric on the extended end of the awning.

10. The assembly of claim 9, wherein the rod is a non-ferrous rod.

11. The assembly of claim 1, wherein the shade fabric further comprises one fabric pocket on each end of a first end and a second end of the top hem thereof for placement over a corresponding side corner of the extended end of the awning.

12. The assembly of claim 1, wherein each first magnet is welded into the fabric.

13. A motorized retractable awning system comprising:

a motorized retractable awning having an extended end; and a drop shade attached to the extended end of the awning, wherein the drop shade is configured to decouple from the extended end of the awning and drop when the motorized retractable awning retracts to a stored position, wherein the drop shade comprises:

a shade fabric with a plurality of first magnets affixed within the fabric in a spaced-apart manner along a length of a top hem of the fabric, wherein each first magnet operatively couples into the fabric;

a plurality of second magnets, wherein each second magnet is paired with a corresponding first magnet and magnetically attached thereto;

a plurality of double-sided adhesive tapes, wherein a first adhesive side of each adhesive tape is applied to a corresponding one of the plurality of second magnets and a second adhesive side is applied to the extended end of the awning to thereby install the shade fabric on the extended end of the awning; and, a pair of rope-like tethers, wherein one end of each tether is directly attached to a corresponding extreme end of the shade fabric and an opposing end of each tether is configured to be secured to the ground, wherein a magnetic attachment between the shade fabric and the extended end of the awning is configured to automatically disengage such that the shade fabric decouples when the motorized retractable awning retracts to a stored position;

wherein the shade fabric comprises:

a plurality of fabric pockets, wherein each pocket is integrally formed in the shade fabric at a location of a corresponding one of the plurality of first magnets over a side of a first magnet of the plurality of first magnets that is unattached to a paired second magnet of the plurality of second magnets when the shade fabric is installed on the extended end of the awning, and wherein each pocket provides a downward-facing opening when the shade fabric is installed on the extended end of the awning.

14. The awning system of claim 13, wherein one of the following applies:

each extreme end of the shade fabric is within the top hem of the fabric; and each extreme end of the shade fabric is below the top hem of the fabric.

15. The awning system of claim 13, wherein a length of the top hem of the fabric is longer than a length of the extended end of the awning.

16. The awning system of claim 13, wherein each first magnet is sewn into the fabric.

17. The awning system of claim 13, wherein each first magnet is welded into the fabric.

18. The awning system of claim 13, wherein the length of the top hem of the fabric is shorter than a length of the extended end of the awning.

* * * * *